US005898957A

United States Patent [19]

Hansen et al.

[11] Patent Number: 5,898,957

[45] Date of Patent: May 4, 1999

[54] SPA TUB WITH VIBRATORY MASSAGE ELEMENT

[75] Inventors: Borg Hansen, Calabasas; Rafael Gonzalez, Lancaster; Thomas R. Thornbury, Toluca Lake, all of Calif.

[73] Assignee: Softub, Inc., Chatsworth, Calif.

[21] Appl. No.: 08/839,720

[22] Filed: Apr. 15, 1997

Related U.S. Application Data

[ 60] Provisional application No. 60/016,414, Apr. 29, 1996.

[51] Int. Cl.[6] ..... A61H 1/00; A61H 33/00

[52] U.S. Cl. ..... 4/541.1; 4/496; 601/49; 601/157; 607/87

[58] Field of Search ..... 4/491, 496, 541.1, 4/571.1, 573.1, 574.1, 575.1; 607/81, 85–87; 601/49, 67, 154, 157, 167

[56] References Cited

U.S. PATENT DOCUMENTS

| | | | |
|---|---|---|---|
| 3,055,357 | 8/1962 | Redka | 607/86 |
| 4,620,529 | 11/1986 | Kurosawa | 601/157 |
| 4,839,930 | 6/1989 | Watkins | 4/541.1 |
| 4,935,972 | 6/1990 | Brady | 4/575.1 |
| 5,042,479 | 8/1991 | Brotz | 4/491 |
| 5,092,951 | 3/1992 | Popovich et al. | 4/541.1 |
| 5,437,608 | 8/1995 | Cutler | 601/49 |
| 5,588,161 | 12/1996 | Barradas | 607/86 |

*Primary Examiner*—Charles R. Eloshway

*Attorney, Agent, or Firm*—Kelly Bauersfeld Lowry & Kelley, LLP

[57] ABSTRACT

An improved therapeutic spa or hot tub or the like, such as a spa or hot tub of the type described in U.S. Pat. No. 5,092,951, includes at least one and preferably a plurality of vibratory mechanical massage elements incorporated into the tub wall at selected locations to provide tub users with a therapeutic vibratory massage action. The vibratory massage element or elements are used in combination with conventional hydraulic air-water spa jets to provide the spa tub with improved therapeutic effect.

13 Claims, 3 Drawing Sheets

SPA TUB WITH VIBRATORY MASSAGE ELEMENT

This application claims benefit of provisional application 60/016,414 filed Apr. 29, 1996.

BACKGROUND OF THE INVENTION

This invention relates generally to improvements in therapeutic spa tubs or hot tubs and the like. More specifically, this invention relates to an improved spa tub or hot tub having one or more vibratory mechanical massage elements incorporated directly into the tub wall at one or more selected locations, to provide a therapeutic massage action which is especially effective when used in combination with conventional air-water hydrotherapy spa jets.

Therapeutic spa tubs or hot tubs and the like are generally known in the art and typically comprise an upwardly open tub structure adapted to contain a selected volume of water. Control means are normally associated with the tub structure for heating the water, and for circulating the water through air-water hydrotherapeutic massage jets. One or more persons can sit within the tub, partially immersed within the heated water, in positions so that the spa jets are directed against the body to provide a therapeutic massage action. One preferred construction for a spa or hot tub of this general type comprises resilient foam wall structures covered by a waterproof flexible liner, as shown and described in U.S. Pat. No. 5,092,951 which is incorporated by reference herein.

SUMMARY OF THE INVENTION

The present invention is directed to an improved spa or hot tub construction, particularly of the resilient foam wall configuration as shown and described in U.S. Pat. No. 5,092,951. The present invention comprises the inclusion of at least one and preferably multiple vibratory mechanical massage elements mounted within or directly onto the tub wall at a selected locations to provide a therapeutic vibratory massage action.

In one preferred form of the invention, the vibratory mechanical massage elements are mounted about the tub wall near an upper end thereof, preferably at or slightly above the normal filled tub water line. The massage elements are mounted within the tub wall a short distance below the wall surface, and may be covered by a selected thickness of cushioning material provided as part of the tub wall structure. Importantly, the vibratory massage elements are protected against exposure to the tub water by the waterproof liner. In another preferred embodiment, the vibratory massage elements are each carried by a vibrator plate adapted for mounting to an inboard side of the tub liner.

The vibratory massage elements are, in the preferred embodiment, used in combination with one or more air-water hydrotherapy massage jets which are incorporated into the tub wall at selected positions below the normal tub water line. The vibratory mechanical massage elements, in combination with the hydrotherapy massage jets, provide an enhanced overall therapeutic effect.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 3:
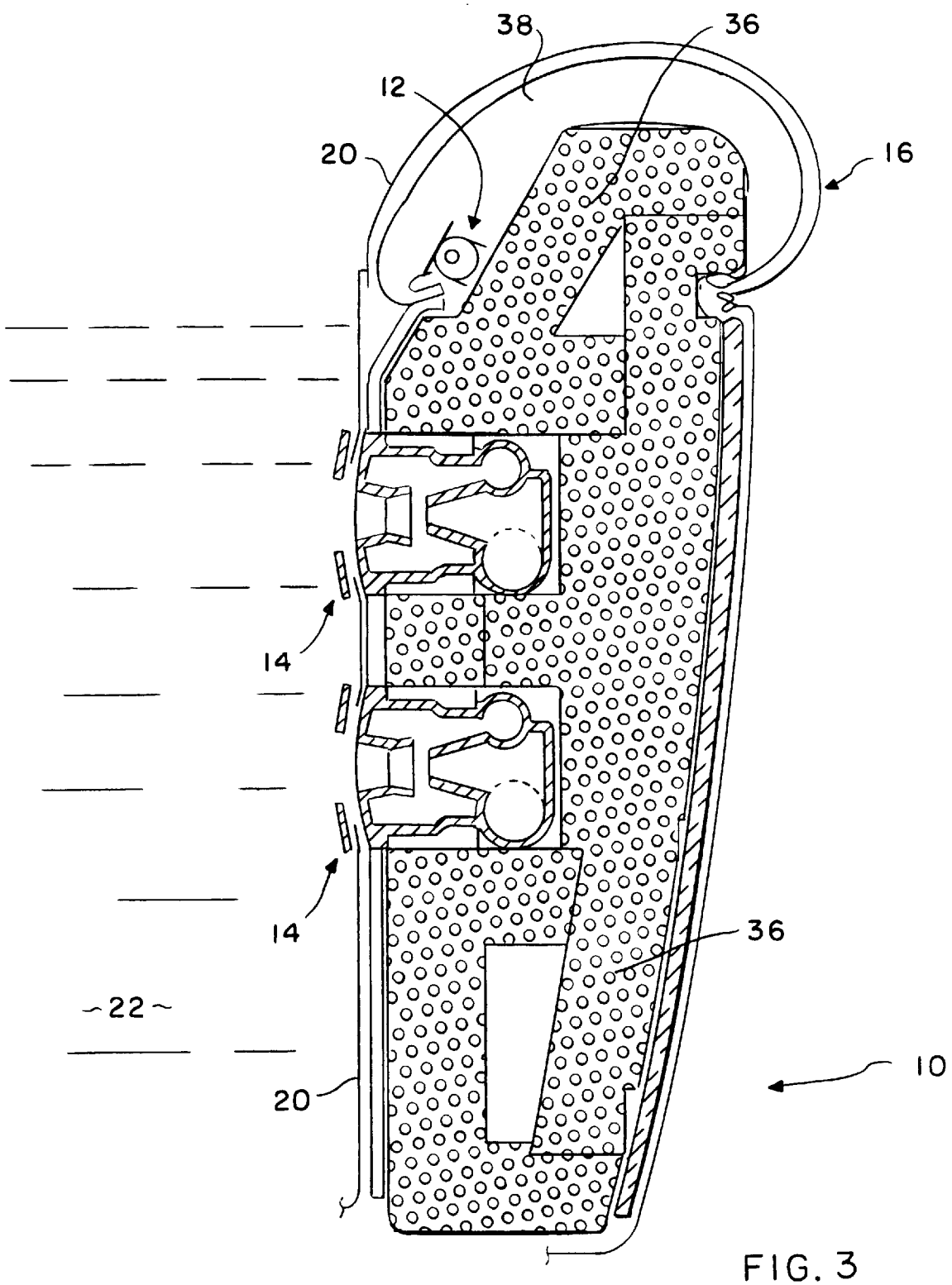
FIG. 3 is a further enlarged and fragmented sectional view illustrating the combination of vibratory mechanical massage elements with hydrotherapy spa jets in accordance with the present invention.

As shown in the accompanying drawings, and particularly with reference to FIG. 3, the present invention pertains to an improved spa or hot tub 10 having one or more vibratory mechanical massage elements 12 incorporated into the upstanding side wall of the tub. In the preferred form, a plurality of vibratory massage elements 12 are installed into the tub side wall at spaced positions about the tub periphery as viewed schematically in FIG. 1, and are utilized in combination with a plurality of conventional air-water hydrotherapy spa jets 14 to provide an overall highly effective therapeutic massage action.

Figure 1:
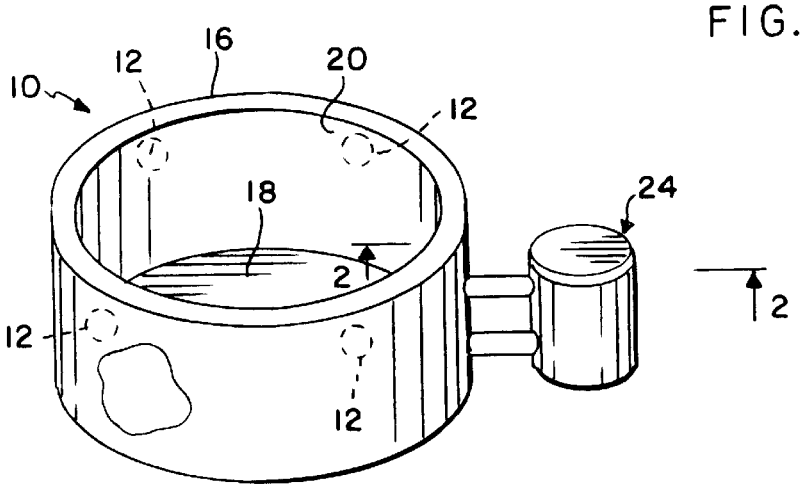
FIG. 1 is a perspective view illustrating a therapeutic spa or hot tub of the type described in U.S. Pat. No. 5,092,951.
Figure 2:
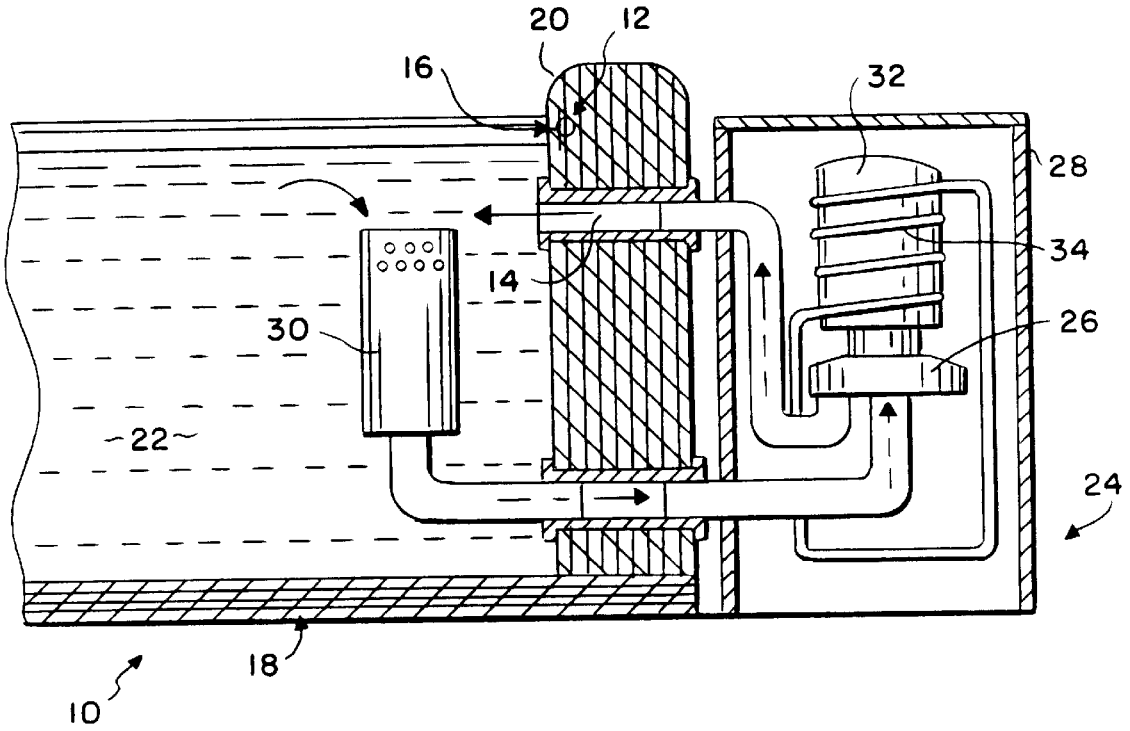
FIG. 2 is an enlarged fragmented vertical sectional view taken generally on the line 2—2 of FIG. 1.

FIGS. 1 and 2 illustrate one preferred construction for a spa or hot tub 10 adapted to include the vibratory mechanical massage elements 12, in accordance with the present invention as viewed in FIG. 3. Except for the vibratory elements 12, FIGS. 1 and 2 depict a prior art spa or hot tub in conformance with commonly assigned U.S. Pat. No. 5,092,951, which is incorporated by reference herein.

More specifically, the illustrative spa tub 10 shown in FIGS. 1 and 2 comprises an upstanding annular side wall 16 attached to a generally circular bottom wall 18. The side wall 16 and bottom wall 18 are preferably constructed from multiple layers of resilient foam plastic sheeting or the like and protectively covered or encased within an outer waterproof flexible liner 20. The assembled side and bottom walls 16, 18, with the liner 20, define an upwardly open volume for receiving a body of water 22 (FIG. 2). The overall size of the spa tub 10 is sufficient to accommodate seating of one or more individuals during spa use.

A control means 24 is provided for circulating the spa water 22 from the tub and through appropriate filtering and heating apparatus, and for returning the filtered and heated water to the spa tub through at least one and preferably a plurality of hydrotherapy spa jets 14. As is known in the art, these spa jets 14 may desirably include means for entraining air with the recirculated water to provide an enhanced and vigorous massage action when jetted against the body of a person sitting within the tub.

FIG. 2 shows an exemplary construction for the control means 24, as described in the above-cited U.S. Pat. No. 5,092,951. More particularly, a pump 26 encased within a pump housing or module 28 draws water from the tub 10 through a filter 30, for recirculation to the spa via one or more spa jets 14. An electric motor 32 which drives the pump 26 produces sufficient heat for elevating the water temperature. Toward this end, a portion of the spa water circulated by the pump 26 is drawn through a heating loop 34 for heat exchange association with the motor 32, prior to return flow to the spa tub.

FIG. 3 shows the construction of the tub side wall 16 in more detail, to include a plurality of resilient foam wall members 36 supportively encased within the waterproof flexible liner 20. The wall members 36 are shaped to define appropriate pockets and/or cavities to accommodate the plumbing components of the control means 24, particularly the hydrotherapy spa jets 14 and related air and water piping as shown. These spa jets 14 are conventional in design and are adapted for water return flow with a jet action into the spa interior, while drawing air into the return jet to produce a vigorous hydrotherapy massage action. FIG. 3 shows two spa jets 14 at vertically spaced positions, both of which are disposed for providing a hydrotherapy jet at a location below the normal water surface line within the spa tub.

FIG. 3 further shows a vibratory mechanical massage element 12 incorporated into the tub side wall 16 near the top thereof, and at a generally inboard-mounted location. The vibratory massage element 12 has a conventional design, typically to include an electric motor with an output shaft carrying an eccentric weight thereon. The electric motor is adapted to be powered for purposes of producing a mechanical vibratory action within the structure of the tub side wall. A preferred massage element is designed for 12 volt DC operation, and may be powered and controlled by the control means 24, as previously described. It will be understood that the invention contemplates a plurality of such massage elements 12 located about the periphery of the tub side wall 16, preferably at locations disposed generally at or slightly above the tub water line.

FIG. 3 shows the vibratory message element 12 mounted between one of the tub structural wall members 36 and an overlying resilient cap or pad 38. The cap or pad 38 is in turn disposed protectively within the waterproof flexible liner 20. Accordingly, the massage element 12 is protected against water contact by the liner 20, and further located with a short thickness of resilient material between the mechanical vibratory device and the inboard spa surface. With this arrangement, the vibratory action it effectively distributed in a pleasing and comfortable therapeutic fashion over a substantial area of the tub side wall.

In use, a person sitting in the spa tub can orient his or her body to take advantage of the combined therapeutic effects of the hydrotherapy jets 14 as well as the vibratory massage element 12. Accordingly, an overall enhanced and highly effective therapeutic action is achieved.

Figure 4:
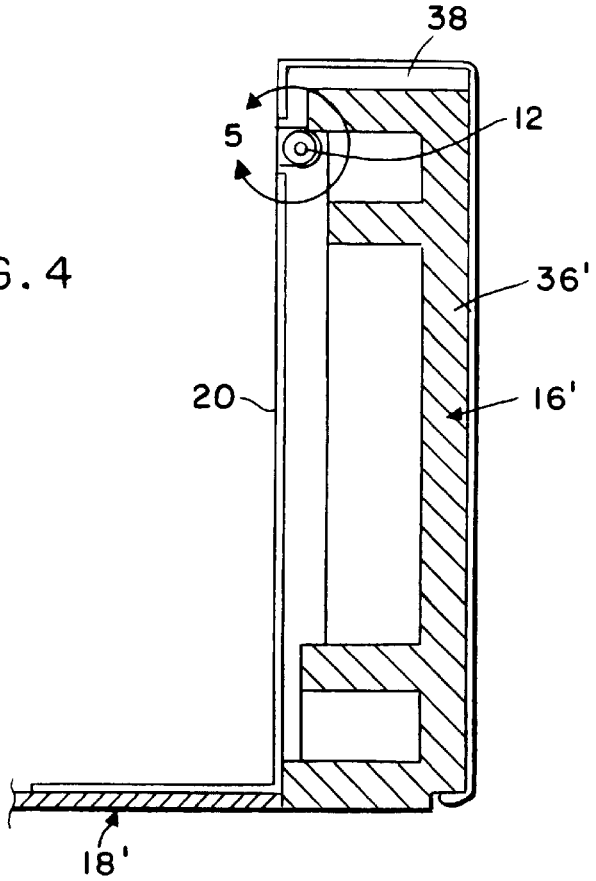
FIG. 4 is an enlarged and fragmented sectional view similar to FIG. 3, but illustrating an alternative form of the invention.
Figure 5:
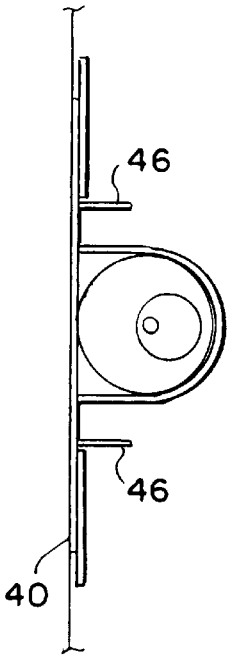
FIG. 5 is an enlarged fragmented sectional view corresponding generally with the encircled region 5 of FIG. 4.
Figure 6:
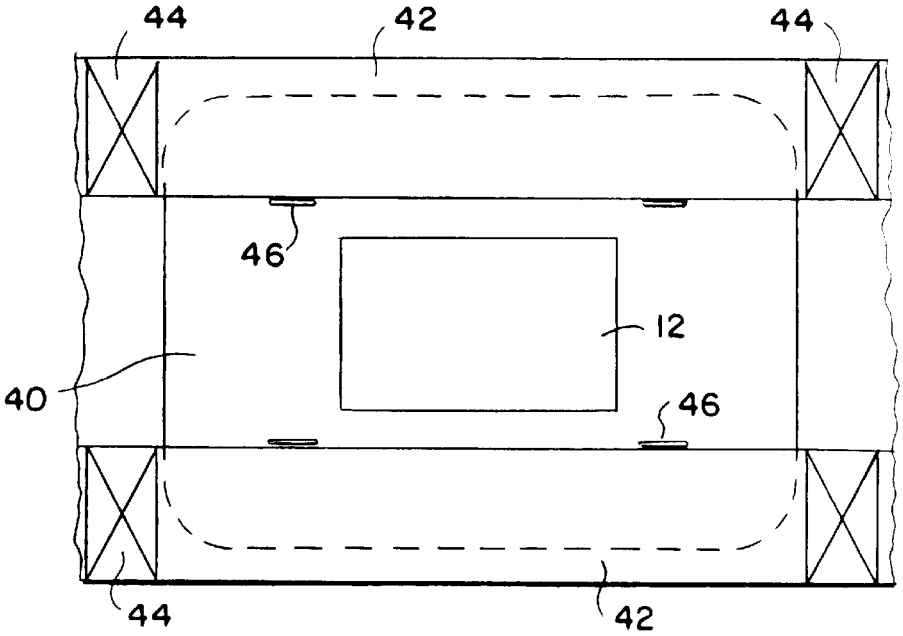
FIG. 6 is an inboard side elevational view taken generally on the line 6—6 of FIG. 5.

FIGS. 4–6 illustrate an alternative and most preferred form of the invention, wherein a spa wall 16' is constructed from molded resilient foam material 36' or the like to define internal pockets or cavities to receive the spa tub plumbing components as described previously with respect to FIGS. 1–3. A waterproof flexible liner 20 is mounted over the spa wall 16' and a related bottom 18' to define the upwardly open water-receiving volume. A resilient cap or pad 38 is again provided at the top of the spa wall 16', in a position beneath the liner 20.

In the embodiment of FIGS. 4–6, one or more vibratory massage elements 12 are mounted to the liner 20 at positions protectively within the wall structure and located vertically at or slightly above the tub water line. As shown, this mounting is achieved by attaching each massage element 12 to an enlarged and generally rectangular vibratory plate 40. This vibratory plate 40 is constructed from a sufficiently rigid material, such as a steel plate, to distribute vibrations from the massage element 12 over a broad surface area of the liner 20. Such broad area distribution of the vibrations is accomplished by securing the plate 40 relative to the liner 20 by a pair of parallel-mounted straps 42 of vinyl or the like having their opposite ends connected to the liner 20 by heat seals 44, whereby the straps 42 define a pocket to receive and support the vibratory plate 40. Tabs 46 are conveniently provided on the plate 40 and project away from the liner 20 to engage the straps 42 and thereby to assist in locating and supporting the plate 40 on the liner 20.

In use, when the massage element 12 shown in FIGS. 4–6 is energized by the appropriate control means, vibrations are freely transmitted to the flexible liner over a broad surface area thereof to provide a pleasing and therapeutic effect to a person sitting in the spa tub with a portion of the body contacting the spa wall liner. The massage element 12 shown in FIGS. 4–6 may be used in combination with air-water jets 14 of the type shown in FIG. 3, but use of such air-water jets is not required.

A variety of modifications and improvements to the spa tub 10 of the present invention will apparent to those skilled in the art. Accordingly, no limitation on the invention is intended by way of the foregoing description and accompanying drawings, except as set forth in the appended claims.

What is claimed is:

1. In a spa tub for containing a body of water and to accommodate substantially seated reception of at least one person within said body of water, and including control means for heating the water and for circulating the heated water to the spa tub through at least one hydrotherapy message jet mounted on an upstanding side wall of the spa tub, said side wall being encased within a waterproof liner, the improvement comprising:

at least one vibratory mechanical message elements mounted on said liner to provide a therapeutic message action to a person within the spa tub, said vibratory mechanical message element being located within a pocket formed within said side wall and separated from the body of the water by said liner;

said vibratory mechanical massage element including a vibratory member coupled to a vibratory plate, and strap means mounted on said liner to define a pocket to receive and support said vibratory plate.

2. The improvement of claim 1 wherein said at least one vibratory mechanical massage element comprises a plurality of vibratory mechanical massage elements located at spaced locations along said side wall.

3. The improvement of claim 1 wherein said vibratory mechanical massage element is mounted on said liner at a location generally at or above a normal filled tub water line.

4. The improvement of claim 1 wherein said vibratory mechanical massage element further includes tab means projects from said vibratory plate in a direction away from said liner for engaging said strap means to retain said massage element on said liner.

5. A spa tub, comprising:

a bottom wall connected to an upstanding side wall to cooperatively define an upwardly open volume for containing a body of water and to accommodate substantially seated reception of at least one person within the body of water, said side wall being encased within a waterproof liner; and a least one vibratory mechanical massage element mounted on said liner to provide a therapeutic vibratory massage action to a person within the spa tub, said at least one vibratory mechanical massage element being located within a pocket formed within said side wall and separated from the body of water by said liner;

said vibratory mechanical massage element including a vibratory member coupled to a vibratory plate, and strap means mounted on said liner to define a pocket to receive and support said vibratory plate.

6. The spa tub of claim 5 further including control means for circulating water from the spa tub into association with a heater to elevate the water temperature, and for returning the heated water to the spa tub through at least one hydrotherapy message jet mounted on said side wall at a location below a normal filled tub water line.

7. The spa tub of claim 6 wherein said at least one hydrotherapy massage jet comprises a plurality of hydrotherapy massage jets mounted at spaced locations along said side wall.

8. The spa tub of claim 7 wherein said at least one vibratory mechanical massage element comprises a plurality of vibratory mechanical massage elements located at spaced locations along said side wall.

9. The spa tub of claim 5 wherein said vibratory mechanical massage element is mounted on said liner at a location generally at or above the normal filled tub water line.

10. The spa tub of claim 5 wherein said vibratory mechanical massage element further includes tab means projecting from said vibratory plate in a direction away from said liner for engaging said strap means to retain said massage element on said liner.

11. A spa tub, comprising:

a bottom wall connected to an upstanding side wall cooperatively define an upwardly open volume for containing a body of water and to accommodate substantially seated reception of at least one person within the body of water, said side wall being encased within waterproof liner;

control means for circulating water from the spa tub into association with a heater to elevate the water temperature, and for returning the heated water to the spa tub through at least one hydrotherapy massage jet mounted on said side wall at a location below a normal filled tub water line; and at least one vibratory mechanical massage element mounted on said liner at a location at or above the normal filled tub water line to provide a therapeutic vibratory massage action to a person within the spa tub, said at least one vibratory mechanical massage element being located within a pocket formed within said side wall and separated from the body of water by said liner;

said vibratory mechanical massage element including a vibratory member coupled to a vibratory plate, and strap means mounted on said liner to define a pocket to receive and support said vibratory plate.

12. The spa tub of claim 11 wherein said at least one hydrotherapy massage jet comprises a plurality of hydrotherapy massage jets mounted at spaced locations along said wall, and further wherein said at least one vibratory mechanical massage element comprises a plurality of vibratory mechanical massage elements located at spaced locations along said side wall.

13. The spa tub of claim 11 wherein said vibratory mechanical massage element further includes tab means projecting from said vibratory plate in a direction away from said liner for engaging said strap means to retain said message element on said liner.

* * * * *